US007932867B2

(12) United States Patent
Tuttle

(10) Patent No.: US 7,932,867 B2
(45) Date of Patent: Apr. 26, 2011

(54) METHODS AND SYSTEMS OF CHANGING ANTENNA POLARIZATION

(75) Inventor: John R. Tuttle, Boulder, CO (US)

(73) Assignee: Round Rock Research, LLC, Mt. Kisco, NY (US)

( * ) Notice: Subject to any disclaimer, the term of this patent is extended or adjusted under 35 U.S.C. 154(b) by 0 days.

(21) Appl. No.: 12/906,516

(22) Filed: Oct. 18, 2010

(65) Prior Publication Data

US 2011/0032171 A1 Feb. 10, 2011

Related U.S. Application Data

(63) Continuation of application No. 11/740,393, filed on Apr. 26, 2007, now Pat. No. 7,825,867.

(51) Int. Cl.
*H01Q 3/00* (2006.01)

(52) U.S. Cl. ..... 343/758

(58) Field of Classification Search ..... 343/756, 343/893, 905, 758
See application file for complete search history.

(56) References Cited

U.S. PATENT DOCUMENTS

| | | | |
|---|---|---|---|
| 2,256,619 | A | 9/1941 | Luck |
| 3,721,990 | A | 3/1973 | Gibson et al. |
| 3,727,230 | A | 4/1973 | Doi |
| 3,859,652 | A | 1/1975 | Hall et al. |
| 3,967,202 | A | 6/1976 | Batz |
| 4,016,553 | A | 4/1977 | Novikoff et al. |
| 4,075,632 | A | 2/1978 | Baldwin et al. |
| 4,260,983 | A | 4/1981 | Falck et al. |
| 4,274,083 | A | 6/1981 | Tomoeda |
| 4,333,072 | A | 6/1982 | Beigel |
| 4,510,495 | A | 4/1985 | Sigrimis et al. |
| 4,525,713 | A | 6/1985 | Barletta et al. |
| 4,539,660 | A | 9/1985 | Miyauchi et al. |
| 4,572,976 | A | 2/1986 | Fockens |
| 4,596,988 | A | 6/1986 | Wanka |
| 4,630,044 | A | 12/1986 | Polzer |
| 4,641,374 | A | 2/1987 | Oyama |
| 4,646,090 | A | 2/1987 | Mawhinney |
| 4,651,157 | A | 3/1987 | Gray et al. |
| 4,654,658 | A | 3/1987 | Walton |
| 4,656,472 | A | 4/1987 | Walton |
| 4,724,427 | A | 2/1988 | Carroll |
| 4,730,188 | A | 3/1988 | Milheiser |
| 4,740,792 | A | 4/1988 | Sagey et al. |
| 4,782,342 | A | 11/1988 | Walton |
| RE32,856 | E | 2/1989 | Millsap et al. |
| 4,809,009 | A | 2/1989 | Grimes et al. |
| 4,819,053 | A | 4/1989 | Halavais |
| 4,822,990 | A | 4/1989 | Tamada et al. |
| 4,854,328 | A | 8/1989 | Pollack |

(Continued)

OTHER PUBLICATIONS

Beebe, Paul, "High-Tech Rules Ada," The Idaho Statesman, Jul. 11, 1993, reprinted in "Micron Morning Report," Jul. 16, 1993.

(Continued)

*Primary Examiner* — Huedung Mancuso
(74) *Attorney, Agent, or Firm* — Lerner, David, Littenberg, Krumholz & Mentlik, LLP

(57) ABSTRACT

A switch assembly selectively couples an antenna communication circuit to a first feed point of a first antenna, and selectively couples the antenna communication circuit to a second feed point of a second antenna. Each feed point is selected based on polarization of an electromagnetic wave to be radiated from or received by the corresponding antenna.

21 Claims, 6 Drawing Sheets

U.S. PATENT DOCUMENTS

| | | | | |
|---|---|---|---|---|
| 4,857,893 | A | 8/1989 | Carroll | |
| 4,862,160 | A | 8/1989 | Ekchian et al. | |
| 4,870,419 | A | 9/1989 | Baldwin et al. | |
| 4,888,591 | A | 12/1989 | Landt et al. | |
| 4,890,072 | A | 12/1989 | Espe et al. | |
| 4,890,075 | A | 12/1989 | Pohlmann et al. | |
| 4,904,983 | A | 2/1990 | Mitchell | |
| 4,912,471 | A | 3/1990 | Tyburski et al. | |
| 4,918,458 | A | 4/1990 | Brunner et al. | |
| 4,920,450 | A | 4/1990 | Masiulis | |
| 4,926,182 | A | 5/1990 | Ohta et al. | |
| 4,937,581 | A | 6/1990 | Baldwin et al. | |
| 5,046,130 | A | 9/1991 | Hall et al. | |
| 5,051,726 | A | 9/1991 | Copeland et al. | |
| 5,055,851 | A | 10/1991 | Sheffer | |
| 5,084,699 | A | 1/1992 | DeMichele | |
| 5,086,389 | A | 2/1992 | Hassett et al. | |
| 5,103,235 | A | 4/1992 | Clemens | |
| 5,126,749 | A | 6/1992 | Kaltner | |
| 5,134,085 | A | 7/1992 | Gilgen et al. | |
| 5,136,719 | A | 8/1992 | Gaskill et al. | |
| 5,142,292 | A | 8/1992 | Chang | |
| 5,144,314 | A | 9/1992 | Malmberg et al. | |
| 5,164,985 | A | 11/1992 | Nysen et al. | |
| 5,175,774 | A | 12/1992 | Truax et al. | |
| 5,198,826 | A | 3/1993 | Ito | |
| 5,272,367 | A | 12/1993 | Dennison et al. | |
| 5,287,112 | A | 2/1994 | Schuermann | |
| 5,300,875 | A | 4/1994 | Tuttle | |
| 5,323,150 | A | 6/1994 | Tuttle | |
| 5,334,974 | A | 8/1994 | Simms et al. | |
| 5,365,551 | A | 11/1994 | Snodgrass et al. | |
| 5,374,930 | A | 12/1994 | Schuermann | |
| 5,406,263 | A | 4/1995 | Tuttle | |
| 5,420,757 | A | 5/1995 | Eberhardt et al. | |
| 5,446,447 | A | 8/1995 | Carney et al. | |
| 5,448,110 | A | 9/1995 | Tuttle et al. | |
| 5,448,242 | A | 9/1995 | Sharpe et al. | |
| 5,461,385 | A | 10/1995 | Armstrong | |
| 5,471,212 | A | 11/1995 | Sharpe et al. | |
| 5,479,172 | A | 12/1995 | Smith et al. | |
| 5,479,416 | A | 12/1995 | Snodgrass et al. | |
| 5,489,546 | A | 2/1996 | Ahmad et al. | |
| 5,500,650 | A | 3/1996 | Snodgrass et al. | |
| 5,519,621 | A | 5/1996 | Wortham | |
| 5,521,600 | A | 5/1996 | McEwan | |
| 5,525,993 | A | 6/1996 | Pobanz et al. | |
| 5,572,226 | A | 11/1996 | Tuttle | |
| 5,621,412 | A | 4/1997 | Sharpe et al. | |
| 5,649,296 | A | 7/1997 | MacLellan et al. | |
| 5,656,978 | A | 8/1997 | Bianu et al. | |
| 5,668,560 | A | 9/1997 | Evans et al. | |
| 5,719,586 | A | 2/1998 | Tuttle | |
| 5,894,266 | A | 4/1999 | Wood, Jr. et al. | |
| 5,970,398 | A | 10/1999 | Tuttle | |
| 6,122,494 | A | 9/2000 | Tuttle | |
| 6,243,013 | B1 | 6/2001 | Duan et al. | |
| 6,292,153 | B1 * | 9/2001 | Aiello et al. | 343/767 |
| 6,434,368 | B1 | 8/2002 | Stadmark | |
| 6,466,131 | B1 | 10/2002 | Tuttle et al. | |
| 6,466,634 | B1 | 10/2002 | O'Toole et al. | |
| 6,574,454 | B1 | 6/2003 | Tuttle | |
| 7,450,076 | B1 * | 11/2008 | Lin et al. | 343/702 |
| 2003/0174099 | A1 | 9/2003 | Bauer et al. | |
| 2005/0083179 | A1 | 4/2005 | Carrender et al. | |
| 2006/0007044 | A1 | 1/2006 | Crouch et al. | |
| 2007/0152831 | A1 | 7/2007 | Eisele | |
| 2009/0058649 | A1 | 3/2009 | Tuttle | |
| 2010/0123629 | A1 * | 5/2010 | Lin et al. | 343/700 MS |
| 2010/0277376 | A1 * | 11/2010 | Chakam et al. | 343/702 |

OTHER PUBLICATIONS

Johnson. Cameron et al., "Data Transmission via Polarization Modulation of a 2.4 Ghz Circulary Polarized Radio Wave", Students of Advanced Laboratory, Department of Physics, UMR.

Mitsubishi Motors Corporation, "Eclipse: Safety and Security." located at http://www.mitsubishi-motors.co.ip.r/products/Eclipse/eclipse_04_html, 1995.

O'Toole, James E., U.S. Appl. No. 60/017,900, filed May 13, 1996.

Transponder News, "Amtech Awarded $5.6 Million Contract to Install and Maintain Toll Collection System," located at http://'www.pix.za/trolley/news.html, Feb. 29, 1996.

Transponder News, Amtech to Install Hands-Free AEI System for Tracking Dillard's Mortor Freight Fleet,' located at http://www.pix.za/trolley/news.hlml, Feb. 21, 1996.

Transponder News, "Tagmaster Finds Wide Spread Applications," located at http://www.pix.za/trolley/news.html Feb. 1996.

Transponder News, "Texas Instruments and Remote Systems Applications Make Effective TAG Team Against Auto Theft." located al hIlp://pix.za/trolley/news.htrIll, Jan. 6, 1995.

Tuttle, John R., "A Low-Power Spread Spectrum CMOS RFID for Radio Identification Applications," Conference Proceedings of RF Expo West, pp. 216-222, Mar. 22, 1994.

Tuttle, John R., U.S. Appl. No. 11/848,295, filed Aug. 31, 2007.

Tuttle, John R., U.S. Appl. No. 121132,594, filed Jun. 3, 2008.

Tuttle, John, "Digital RF/ID Enhances GPS," Proceedings of the Second Annual Wireless Symposium, pp. 406-411, Feb. 15, 1994.

Tuttle, Mark E., U.S. Appl. No. 60/023,321, filed Jul. 30, 1996.

Vittoz, Eric el al., "CMOS Analog Integrated Circuits Based on Weak Inversion Operation," IEEE Journal of Solid State Circuits. vol. SC-12, No. 3, pp. 224-231, Jun. 1997.

Antenna Pattern(s) From Antenna(s) Arranged in a Two-Dimensional Plane for Use in RFID Tags and Labels, now U.S. Patent No. 5,572,226.

Transaction History of related U.S. Appl. No. 08/584,788, filed Jan. 1, 1996, entitled "Spherical Antenna Pattern(s) From Antenna(s) Arranged in a Two-Dimensional Plane for Use in RFID Tags and Labels," now U.S. Patent No. 5,719,586.

Transaction History of related U.S. Appl. No. 08/656,530, filed May 3D, 1996, entitled "Method and Apparatus for Remote Monitoring," now U.S. Patent No. 5,894,266.

Transaction History of related U.S. Appl. No. 08/704,965, filed Aug. 29, 1996, entitled Radio Frequency Antenna with CutTent Controlled Sensitivity: now U.S. Patent No. 5,970,398.

Transaction History of related U.S. Appl. No. 09/172,714, filed Oct. 13, 1998, entitled Radio Frequency Antenna with CutTent Controlled Sensitivity: now U.S. Patent No. 6,122,494.

Transaction History of related U.S. Appl. No. 09/542,800, filed Apr. 4, 2000, entitled Radio Frequency Antenna with CutTent Controlled Sensitivity: now U.S. Patent No. 6,574,454.

Transaction History of related U.S. Appl. No. 11/848,295, filed Aug. 31, 2007, entitled "Selectively Coupling to Feed Points of an Antenna System.".

Transaction History of related U.S. Appl. No. 12/132,594, filed Jun. 3, 2008, entitled "Systems and Methods to Selectively Connect Antennas to Receive and Backscatter Radio Frequency Signals.".

Eric Krantz and Dr. Stuart Riley, "GPS Antenna Design and Periormance Advancements: The Trimble Sephyr," Trimble GPS Engineering and Construction Group, Sunnyvale, California, Pete Large, Trimble Integrated Surveying Group, Westminster, Colorado.

JT Bernhard, etl al. , A Commemoration of Deschamps' and Sichak's Microstrip Microwave Antennas' 50 Years of Development, Divergence, and New Directions; Electromagnetics Laboratory, ECE Department, University of Illinois at Urbana-Campaign, Urbana, IL 61801 Antenna Laboratory, ECE Department, University of Massachusetts, Amherst, Ma 01 003; Air Force Research Laboratory, Sensors Directorate 80 Scott Drive; Hanscom AFB, MA 01731.

* cited by examiner

METHODS AND SYSTEMS OF CHANGING ANTENNA POLARIZATION

CROSS-REFERENCE TO RELATED APPLICATIONS

This application is a continuation of U.S. application Ser. No. 11/740,393, filed on Apr. 26, 2007, the disclosure of which is incorporated herein by reference.

FIELD

At least some of the various embodiments are directed to systems and methods to selectively radiate and/or receive electromagnetic waves having varying electric field polarizations.

DESCRIPTION OF THE RELATED ART

Many systems have a need to radiate (i.e., send) or receive electromagnetic waves with varying electric field polarizations (hereafter just polarization). In some systems, radiating or receiving electromagnetic waves with varying polarization dictates having multiple antennas, with each antenna configured to transmit an electromagnetic wave with a particular polarization (e.g. multiple dipole antennas in different physical orientations, multiple patch antennas in different physical orientations).

To provide varying polarizations, other systems use a single patch antenna having multiple active feed points, with all the active feed points used simultaneously to radiate or receive the electromagnetic waves. Radiating electromagnetic waves with patch antennas having multiple active feed points dictates simultaneously generating several phase-delayed versions of the antenna driving signal, with the multiple phase-delayed antenna driving signals applied one each to the multiple feed points. The amount of phase delay and physical spacing of the feed points on the patch antenna control the polarization of the electromagnetic waves transmitted. Receiving electromagnetic waves with patch antenna having multiple active feed points likewise dictates phase-correcting received signals, and conglomerating the phase-corrected signals to produce a received signal that is proportional to the desired polarization. The amount of phase correction applied to each signal and the physical spacing of the feed points on the patch antenna from which the receive signals originate control the polarization to which the patch antenna is most sensitive.

BRIEF DESCRIPTION OF THE DRAWINGS

For a detailed description of various embodiments, reference will now be made to the accompanying drawings in which.

NOTATION AND NOMENCLATURE

Certain terms are used throughout the following description and claims to refer to particular system components. As one skilled in the art will appreciate, design and manufacturing companies may refer to the same component by different names. This document does not intend to distinguish between components that differ in name but not function. In the following discussion and in the claims, the terms "including" and "comprising" are used in an open-ended fashion, and thus should be interpreted to mean "including, but not limited to . . . .

Also, the term "couple" or "couples" is intended to mean either an indirect or direct connection. Thus, if a first device couples to a second device, that connection may be through a direct connection or through an indirect connection via other intermediate devices and connections. Moreover, the term "system" means "one or more components" combined together. Thus, a system can comprise an "entire system," "subsystems" within the system, a radio frequency identification (RFID) tag, a RFID reader, or any other device comprising one or more components.

DETAILED DESCRIPTION OF DISCLOSED EMBODIMENTS

The various embodiments disclosed herein are discussed in the context of radio frequency identification (RFID) tags and antennas for RFID tags; however, the systems, antennas and methods discussed herein have application beyond RFID tags to other types of electromagnetic wave-based technologies. The discussion of any embodiment in relation to RFID tags is meant only to be illustrative of that embodiment, and not intended to intimate that the scope of the disclosure, including the claims, is limited to that embodiment.

Figure 1:
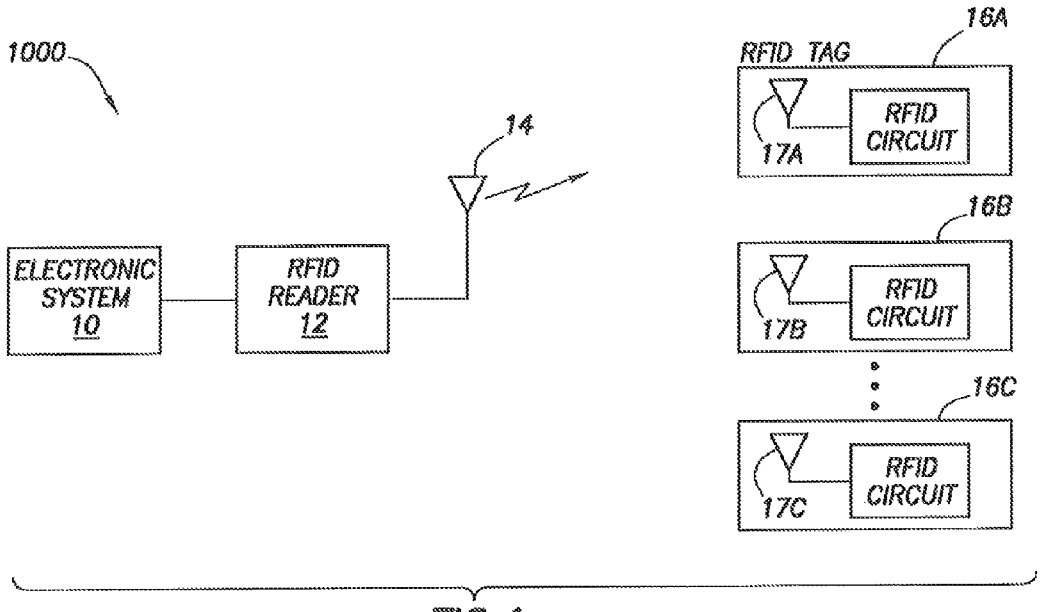
FIG. 1 shows a radio frequency identification (RFID) system in accordance with at least some embodiments.

FIG. 1 illustrates a system 1000 in accordance with at least some embodiments. In particular, system 1000 comprises an electronic system 10 coupled to a RFID reader 12. In some embodiments, electronic system 10 comprises a computer system. By way of antenna 14, the RFID reader 12 communicates with one or more RFID tags 16A-16C proximate to the RFID reader (i.e., within communication range). The RFID reader 12 may be equivalently referred as an interrogator. The RFID reader 12 passes data obtained from the various RFID tags 16 to the electronic system 10, which performs any suitable function. For example, the electronic system 10, based on the data received from the RFID tags 16, may allow access to a building or parking garage, note the entrance of an employee to a work location, direct a parcel identified by the RFID tag 16 down a particular conveyor system, or display an advertisement customized or targeted to the person identified by the RFID tag 16.

There are several types of RFID tags operable in the illustrative system 1000. For example, RFID tags may be active tags, meaning each RFID tag comprises its own internal battery. Using power from the internal battery, an active RFID tag monitors for interrogating signals from the RFID reader 12. When an interrogating signal is sensed, a response comprising a data or identification value is transmitted by the active RFID tag using power from its internal battery. A semi-active tag may likewise have its own internal battery, but a semi-active tag stays dormant most of the time. When an antenna of a semi-active tag receives an interrogating signal, the power received is used to wake or activate the semi-active tag, and a response comprising an identification value is sent by the semi-active RFID tag using power from its internal battery.

A third type of RFID tag is a passive tag, which, unlike active and semi-active RFID tags, has no internal battery. The antenna of the passive RFID tag receives an interrogating signal, and the power extracted from the received interrogating signal is used to power the tag. Once powered, the passive RFID tag may accept a command, send a response comprising a data or identification value, or both; however, the value is sent in the form of backscattered electromagnetic waves to the RFID reader 12 antenna 14 from the antenna 17 of the RFID tag 16. In particular, the RFID reader 12 and antenna 14 continue to transmit power after the RFID tag is awake. While the RFID reader 12 transmits, the antenna 17 of the RFID tag is selectively tuned and de-tuned with respect to the carrier frequency. When tuned, significant incident power is absorbed by the antenna 17 of the RFID tag 16 (and is used to power the underlying circuits). When de-tuned, significant power is reflected by the antenna 17 of the RFID tag 16 to the antenna 24 of the RFID reader 12. The data or identification value thus modulates the carrier in the form of reflected or backscattered electromagnetic wave. The RFID reader 12 reads the data or identification value from the backscattered electromagnetic waves. Thus, in this specification and in the claims, the terms transmitting and transmission include not only sending from an antenna using internally sourced power, but also sending in the form of backscattered signals.

Figure 2:
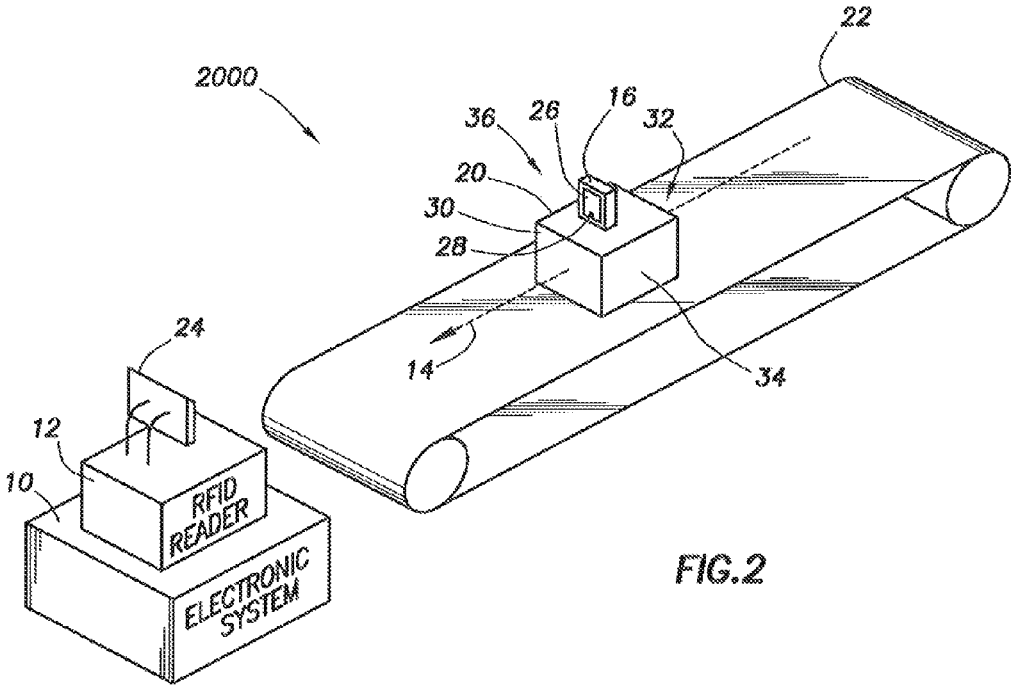
FIG. 2 shows a more detailed system in accordance with at least some embodiments.

FIG. 2 shows a more detailed system 2000 in accordance with some embodiments. In particular, system 2000 shows an object 20 on a conveyor system 22, and in some embodiments with the object 20 selectively moving in the direction indicated by arrow 14. Conveyor system 22 is merely illustrative of any situation where an object 20 may be in a plurality of positions relative to a system for reading the RFID tag 16, such as reading by RFID reader 12. For example, the object 20 and conveyor system 22 are illustrative of wafer boats in semiconductor manufacturing production line, luggage in an automated luggage handling system, parcels in an automated sorting facility, consumer goods in a shopping cart, or participants in a war game. The object 20 has an associated RFID tag 16, which as illustrated is visible both from in front of the object 20, and from behind the object 20. In some embodiments, the RFID tag 16 uses a dual-sided patch antenna, such as described in co-pending and commonly assigned application Ser. No. 11/691,822 titled "Multi-Antenna Element Systems and Related Methods," incorporated by reference herein as if reproduced in full below. In other embodiments, however, any suitable antenna may be used on the RFID tag 16. As illustrated, one antenna element 26 of the RFID tag 16 is visible, with the antenna element 26 having a feed point 28. A second antenna element (not visible in FIG. 2), may also be present, and the second antenna element likewise has a feed point.

The system 2000 further comprises a reading antenna 24 positioned downstream of the direction of travel of the object 20. In other embodiments, the reading antenna 24 may be placed at any suitable position (e.g. upstream of the path of travel), or there may be reading antennas at any position relative to the path of travel. Electronic system 10 and RFID reader 12 couple to the reading antenna 24, and the RFID reader 12 reads the RFID tag 16 by way of an antenna element of the RFID tag 16 (e.g., antenna element 26).

In accordance with various embodiments, the RFID reader 12 and/or electronic system 10 determine certain physical characteristics of the RFID tag 16 and attached object 20. For example, the RFID reader 12 and/or electronic system 10 may be implemented in a system which determines which face or side of the object 20 (e.g., face 30 or 32) is exposed to the reading antenna 24. Likewise, the RFID reader 12 and/or electronic system 10 may be implemented in a system which determines the rotational orientation of the object 20 (e.g. which side 34, 36 faces upwards). These and possibly other physical characteristics of the RFID tag 16 and attached object 20 may be determined by polarization of electromagnetic waves or signals transmitted by the RFID tag 16. Co-pending and commonly assigned application Ser. No. 11/692,538 titled, "Methods and Systems of Determining Physical Characteristics Associated with Objects Tagged with RFID Tags," incorporated by reference herein as if reproduced in full below, describes a plurality of mechanisms to detect physical characteristics of RFID tags and attached objects, some of which are based on polarization of electromagnetic signals received from RFID tags.

As an example of determining physical characteristics of the RFID tag 16 and attached object 20, consider a situation where each face 30, 32 of the object 20 is associated with a particular polarization of electromagnetic signal transmitted from the RFID tag 16 (or possibly multiple RFID tags, one each on each face of the object 20). When interrogated by reading antenna 24, the RFID tag 16 responds with an electromagnetic signal having a particular polarization, and in these embodiments the polarization identifies the which face of the object 20 is exposed to or facing the reading antenna 24. As another example, consider a situation where the polarization of an antenna of the RFID tag 16 is aligned with a rotational orientation of the object 20 (e.g. vertical polarization aligned with upright orientation of the object 20). When interrogated by the reading antenna 24, the RFID tag 16 responds with an electromagnetic signal having a particular polarization, and in these illustrative embodiments the polarization identifies the rotational orientation of the object 20 (e.g. a horizontally polarized electromagnetic signal from the RFID tag 16 indicates the object 20 is laying on its side).

Figure 3:
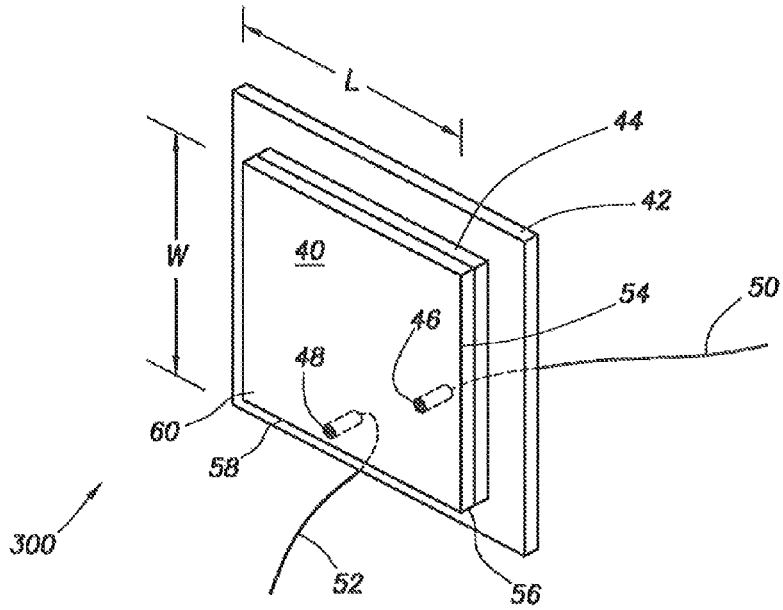
FIG. 3 shows a patch antenna with multiple feed points in accordance with at least some embodiments.

In accordance with at least some embodiments, receiving electromagnetic signals from the RFID tag 16, with the electromagnetic signals having varying polarization, is enabled by a patch antenna having multiple polarizations. In some embodiments, the multiple polarizations are based on multiple feed points, where each feed point is associated with a different polarization of the patch antenna. FIG. 3 illustrates a patch antenna 300 in accordance with at least some embodiments. In particular, patch antenna 300 comprises a radiative patch or antenna element 40. In the embodiments shown, the antenna element 40 comprises a sheet of metallic material (e.g. copper) that defines a perimeter. In the embodiments of FIG. 3, the antenna element 40 is in the form of a square or rectangle. The length ("L" in the figure) and width ("W" in the figure) of the illustrative antenna element 40 is dictated by the wavelength of the radio frequency signal that will be driven to the antenna element 40 (or that will be received by the antenna element 40). More particularly, the length and width of the antenna element 40 are each an integer ratio of the wavelength of the signal to be transmitted (or received). For example, the length L and width W may be approximately half the wavelength ($\lambda/2$) or a quarter of the wavelength ($\lambda/4$).

The patch antenna 300 also comprises a ground plane or ground element 42. The antenna element 40 and the ground element 42 each define a plane, and those planes are substantially parallel in at least some embodiments. In FIG. 3, the ground element 42 length and width are shown to be greater than the length and width of the antenna element 40; however, the ground element length and width may be smaller in other embodiments. Although the antenna element 40 and ground element 42 may be separated by air, in some embodiments a dielectric material 44 (e.g., printed circuit board material, silicon, plastic) separates the antenna element 40 from the ground element 42.

Radio frequency signals are driven to the antenna element 40 by way of probe feeds or feed points (i.e., the locations where the radio frequency signals couple to the antenna element 40), such as feed point 46 or feed point 48. The feed points are shown (in dashed lines) to extend through the antenna element 40, dielectric 44 and ground plane 42, and then to couple to respective leads 50 (for feed point 46) and 52 (for the feed point 48). In other embodiments, the leads 50, 52 may extend to their respective feed points through the dielectric material 44, but not through the ground element 42 (i.e., the leads emerge from the dielectric material). In either case, the feed points are electrically isolated from the ground element 42.

Considering first feed point 46, illustrative feed point 46 resides within the perimeter defined by the antenna element 40, and placement of the feed point is selected based on several criteria. One such criterion is the impedance seen by a radio frequency source that drives the antenna element 40. For example, shifting the feed point 46 toward the center of the antenna element 40 along its length ("L" in the figure) tends to lower the impedance seen by the radio frequency source, while shifting along the length towards an edge (e.g., edge 54) tends to increase impedance seen by the radio frequency source. Moreover, the placement of the feed point 46 also controls polarity of the electromagnetic wave or signal created. For example, illustrative feed point 46 as shown creates an electromagnetic signal with a particular electric field polarization (e.g. horizontal polarization (along the length L)). Shifting the feed point toward a corner (e.g. corner 56) creates a different polarization (e.g. circular polarization).

Illustrative feed point 48 also resides within the perimeter defined by the antenna element 40. Shifting the illustrative feed point 48 toward the center of the antenna element 40 along its width ("W" in the figure) tends to lower the impedance seen by the radio frequency source, while shifting along the width towards an edge (e.g. edge 58) tends to increase impedance seen by the radio frequency source. Moreover, illustrative feed point 48 as shown creates an electromagnetic signal with a particular polarization (e.g. a vertical polarization (along the length W)). Shifting the feed point toward a corner (e.g. corner 60) creates an electromagnetic wave having a different polarization (e.g. circularly polarized). Thus, the feed points are internal to the length and width to meet these, and possibly other, design criteria.

Returning to FIG. 2, the illustrative patch antenna 300 may be used as the reading antenna 24. In this way, a single antenna 24 can be used to radiate electromagnetic waves of varying polarization (e.g. to radiate interrogating signals to an RFID tag), and likewise to receive electromagnetic waves of varying polarization (e.g. receive responses from RFID tags). The discussion now turns to various mechanisms to control which feed point or points are active, and which feed point or points are inactive, for a particular transmission or reception.

Figure 4:
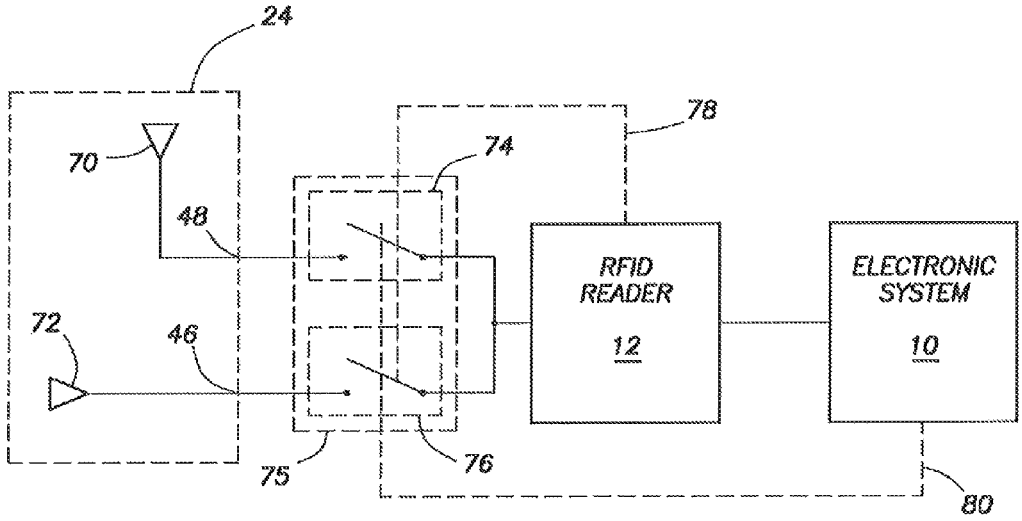
FIG. 4 shows an electrical block diagram of a system in accordance with at least some embodiments.

FIG. 4 shows an electrical block diagram that illustrates coupling of the RFID reader 12 to the reading antenna 24 in accordance with at least some embodiments. In particular, reading antenna 24 is illustrated as two antennas and 72. Antenna 70 is schematically shown upright to signify polarization associated with a first feed point (e.g. feed point 48 which, when used, may transmit or receive electromagnetic signals having an illustrative vertical polarization). Likewise, antenna 72 is shown prone to signify polarization associated with a second feed point (e.g. feed point 46 which, when used, may transmit or receive electromagnetic signals having an illustrative horizontal polarization). The RFID reader 12 couples to each feed point through a switch assembly 75, which is illustrated as individual single-pole single-throw switches 74 and 76. However, in embodiments where the switch assembly 75 couples the RFID reader 12 to the feed points of the patch antenna 24 in a mutually exclusive manner (i.e., one and only one at a time), the switch assembly 75 could be a single-pole double-throw switch.

Consider first a situation where the RFID reader 12 and/or electronic system 10 are configured to transmit electromagnetic signals having an illustrative vertical polarization. In order to make feed point 48 the active feed point, switch 74 is closed or made conducting, while switch 76 is opened or made non-conducting. The RFID reader 12 generates an antenna feed signal, and the antenna feed signal is applied to the first feed point 48 through the switch 74. In turn, the reading antenna 24 radiates an electromagnetic wave having the illustrative vertical polarization. Stated otherwise, the antenna feed signal generated by the RFID reader 12 is applied to feed point 48 to the exclusion of other feed points (i.e., the antenna feed signal is not applied to feed point 46 in the illustration of FIG. 4). Now consider a similar situation, except where the RFID reader 12 and/or electronic system 10 are configured to receive vertically polarized electromagnetic signals. In order to make feed point 48 the active feed point, switch 74 is again closed or made conducting, while switch 76 is again opened or made non-conducting. The reading antenna 24 produces an electrical signal that moves between the feed point 48 and the RFID reader 12, the electrical signal predominantly proportional to vertically polarized electromagnetic radiation incident upon the reading antenna 24.

Next consider situations where the RFID reader 12 and/or electronic system 10 are configured to transmit electromagnetic signals having an illustrative horizontal polarization. In order to make feed point 46 the active feed point, switch 76 is closed or made conducting, while switch 74 is opened or made non-conducting. The RFID reader 12 generates an antenna feed signal, and the antenna feed signal is applied to the feed point 46 through the switch 76. In turn, the reading antenna radiates an electromagnetic wave having the illustrative horizontal polarization. Stated otherwise, the antenna feed signal generated by the RFID reader 12 is applied to feed point 46 to the exclusion of other feed points (i.e., the antenna feed signal is not applied to feed point 48 in the illustration of FIG. 4). Now consider a similar situation, except where the RFID reader 12 and/or electronic system 10 are configured to receive horizontally polarized electromagnetic signals. In order to make feed point 46 the active feed point, switch 46 is again closed or made conducting, while switch 74 is again opened or made non-conducting. The reading antenna 24 produces an electrical signal that moves between the feed point 46 and the RFID reader 12, the electrical signal predominantly proportional to horizontally polarized electromagnetic radiation incident upon the reading antenna 24.

The switch assembly 75 used to selectively to couple the RFID reader 12 to the reading antenna 24 may take many forms. For example, in some embodiments one or more mechanical switches are used, where the mechanic switches are closed (made conducting) or opened (made non-conducting) by physical manipulation of the switches (e.g. knife blade switches). In other embodiments, the switch assembly 75 is one or more electrically controlled switches. Examples of electrically controlled switches that may be used are solenoid operated relays, or solid state switches (e.g., transistors, silicon controlled rectifier pairs). Moreover, there are different types of transistors that may be used, for example metal oxide semiconductor field effect transistors (MOSFETs) or junction transistors. The device that controls the electrically controlled switches 74 and 76 may vary as well. In some embodiments, the RFID reader 12 controls the switch positions of the illustrative switches 74 and 76, as shown by dashed line 78 in FIG. 4. In other embodiments, the electronic system 10 controls the switch positions of the illustrative switches 74 and 76, as shown by dashed lines 80 in FIG. 4.

Figure 5:
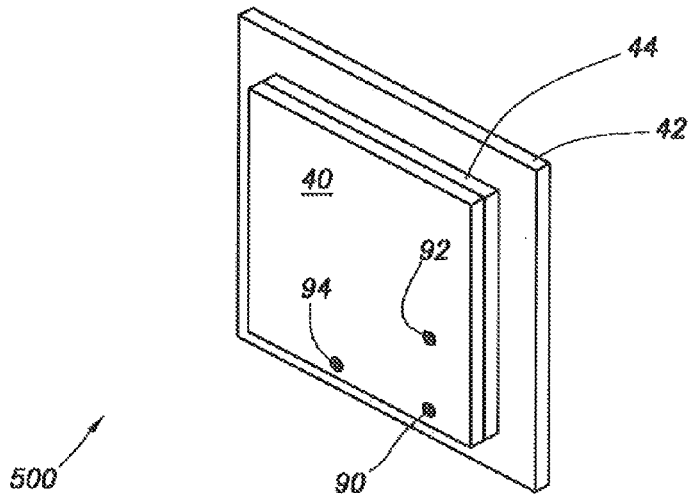
FIG. 5 shows a patch antenna in accordance with other embodiments.

The embodiments discussed to this point have been in reference to an antenna having two feed points, where each feed point is used to the exclusion of the other. However, in other embodiments three or more feed points are used to increase the number of possible polarizations of the reading antenna, and those polarizations may be formed by use of feed points individually, or use of the feed points in groups. For example, FIG. 5 shows a patch antenna 500 in accordance with further embodiments. In particular, patch antenna 500 comprises an antenna element 40 and ground element 42 separated by dielectric 44. Patch antenna 500 further comprises an illustrative three feed points 90, 92 and 94. When feed point 92 is used alone during transmission, the patch antenna 500 creates an electromagnetic wave with a particular polarization (e.g. horizontal polarization). When feed point 94 is used alone during transmission, the patch antenna 500 creates an electromagnetic wave with a different polarization (e.g. vertical polarization). When feed points 90 and 92 are used together (to the exclusion of feed point 94), the patch antenna 500 creates an electromagnetic wave with yet another polarization (e.g., circular polarization). Likewise, when feed points 90 and 94 are used together (to the exclusion of feed point 92), the patch antenna 500 creates an electromagnetic wave with yet still another polarization (e.g. circular polarization, but where the rotational orientation of the polarization is different than that produced when feed points 90 and 92 are used). Thus, a system (such as system 2000 of FIG. 2) may selectively use any polarization that may be transmitted or received by a reading antenna 24.

Figure 6:
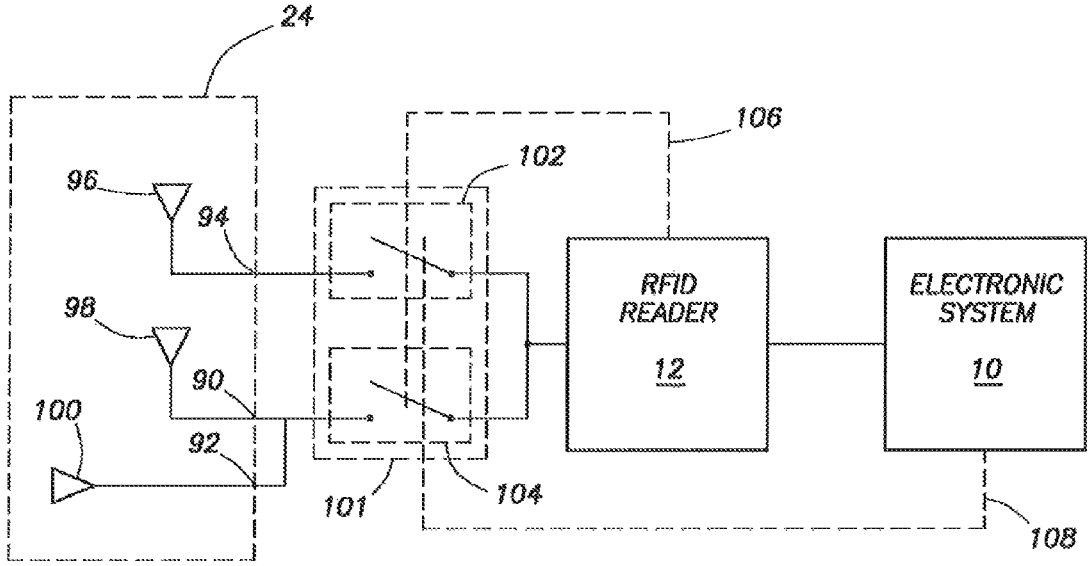
FIG. 6 shows an electrical block diagram of a system in accordance with other embodiments.

FIG. 6 shows an electrical block diagram that illustrates coupling of the RFID reader 12 to the reading antenna 24 in embodiments where feed points are used in groups. In particular, reading antenna 24 is illustrated in this figure as three antennas 96, 98 and 100 (e.g. associated with feed points 94, 90 and 92 respectively of patch antenna 500 of FIG. 5). The RFID reader 12 couples to the reading antenna through a switch assembly 101, which is illustrated as individual single-pole single-throw switches 102 and 104. However, in embodiments where the switch assembly 101 couples the RFID reader 12 to the feed point 94 or a feed point group (comprising feed points 90 and 92) mutually exclusively, the switch assembly 101 could be a single-pole double-throw switch. In the example of FIG. 6, the RFID reader 12 couples to feed point 94 through switch 102, and the RFID reader 12 couples to feed points 90 and 92 through switch 104. The switches 102 and 104 may be of the same type and construction as those discussed with respect to the switch assembly 75 of FIG. 4.

In the configuration illustrated in FIG. 6, a single feed point or group of feed points may be used to radiate and receive electromagnetic waves of particular polarization, with the single feed point or group of feed points selected based on operation of the illustrative switches 102 and 104. For example, when the RFID reader 12 is configured to be sensitive to or send electromagnetic waves of a first polarization (e.g., vertical polarization), switch 102 is closed or made conducting, while switch 104 is opened or made non-conducting. Likewise, when the RFID reader 12 is configured to be sensitive to or send electromagnetic waves having another polarization (e.g. circular polarization), switch 104 is closed on made conducting, while switch 102 is opened or made non-conducting. In yet other embodiments, each feed point may have an associated switch, and when a group of feed points is desired, multiple switches may be made conducting. Like the embodiments discussed with respect to FIG. 4, when illustrative switches 102 and 104 are electrically controlled, control of the switches may be by either the RFID reader 12 (as illustrated by dashed line 106), or by the electronic system (as illustrated by dashed line 108).

Figure 7:
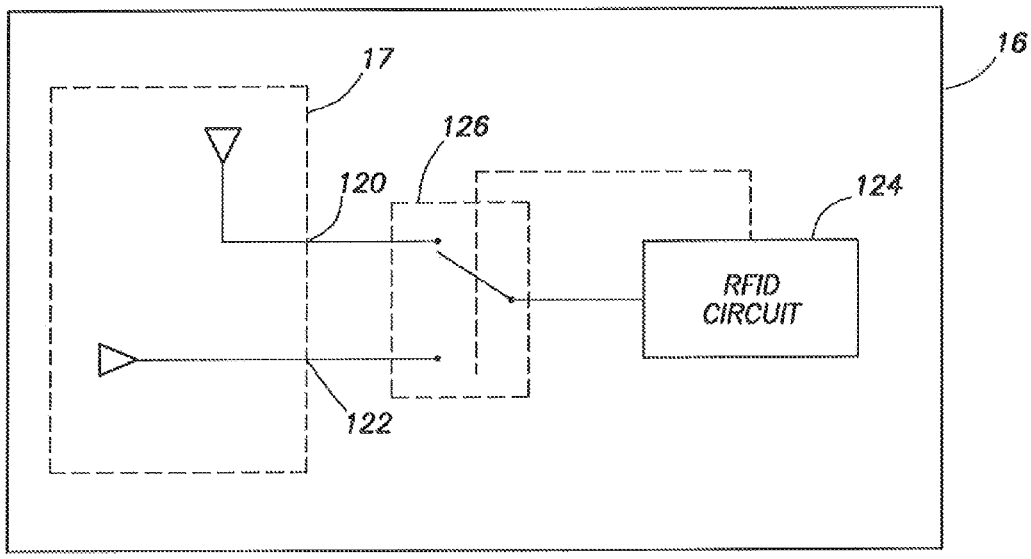
FIG. 7 shows a RFID tag in accordance with at least some embodiments.

The various embodiments discussed to this point have been in relation to the reading antenna 24 having multiple feed points, and having the ability to radiate and receive electromagnetic waves of varying polarization. However, the ability to radiate and receive electromagnetic waves of varying polarization is not limited to the illustrative reading antennas 24 and RFID readers 12, and indeed may also be implemented in RFID tags. FIG. 7 shows an RFID tag 16 in accordance with other embodiments. In particular, the RFID tag 16 comprises a tag antenna 17 having at least two feed points 120 and 122, each feed point associated with a different polarization of the tag antenna 17. The feed points 120 and 122 couple to the RFID circuit 124 by way of a switch assembly 126, which as illustrated is a single-pole double-throw switch, controlled by the RFID circuit 124. In other embodiments, the switch assembly 126 may comprise individual switches (e.g. two single-pole single-throw switches). RFID tags are, in most but not all cases, relatively small (e.g. credit card sized) objects, and thus while mechanical switches and solenoid controlled relays may be used as the switch assembly 126, for size considerations the switch assembly 126 in most situations is solid state.

The RFID circuit 124 may be configured in many ways. In some embodiments the RFID circuit 124 controls the switch assembly 126 and transmits electromagnetic signals with particular polarization responsive to specific commands from an RFID reader. In other embodiments, the RFID circuit is preprogrammed to transmit electromagnetic signals of varying polarization, such as in a progression after each interrogation, or alternating polarizations based on successive interrogations.

Figure 8:
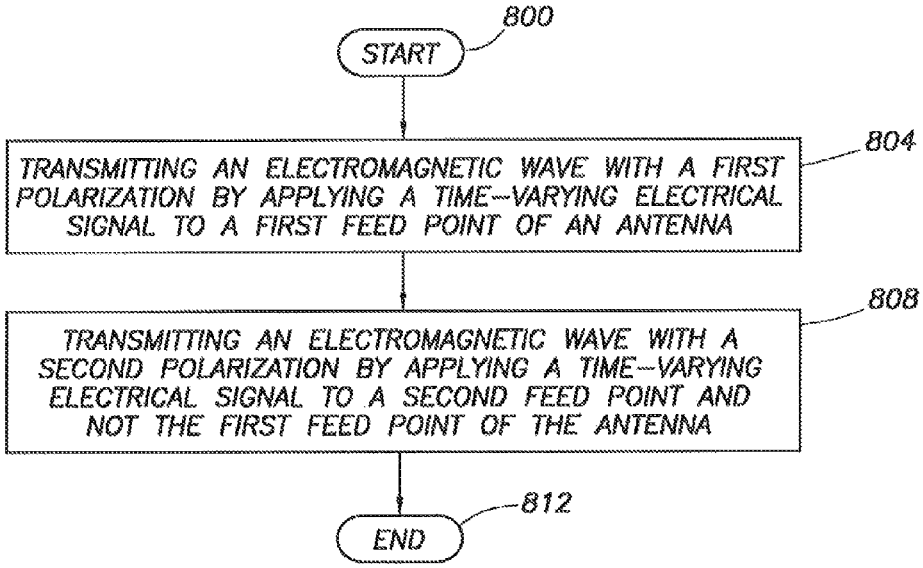
FIG. 8 shows a method in accordance with at least some embodiments.

FIG. 8 shows a method in accordance with at least some embodiments. In particular, the method starts (block 800) and proceeds to transmitting an electromagnetic wave with a first polarization by applying an antenna feed or time-varying electrical signal to a first feed point of an antenna (block 804). In some embodiments, applying the time-varying electrical signal comprises coupling the time-varying electrical signal to the first feed point by way of switch. Switch may take many forms, for example: a mechanical switch; a solenoid operated relay; a fuel effect transistor; a junction transistor, or a silicon control rectifier pair. Likewise, the reason for the transmitting may take many forms. In some embodiments, the transmitting electromagnetic wave with the first polarization may be from an antenna communication circuit to read a RFID tag coupled to an object, here the antenna communication circuit being an RFID reader 12. In other embodiments, an antenna communication circuit being an RFID circuit 124 on an RFID tag 16 may transmit the electromagnetic wave with the first polarization, such as in response to an interrogating signal from an RFID reader.

Regardless of the physical mechanism of applying the time-varying electrical signal to the first feed point of the antenna, or the reason for transmitting the electromagnetic wave, the next step in the illustrative method may be transmitting an electromagnetic with a second polarization (different from the first polarization), the transmitting the second electromagnetic wave by applying a time-varying electrical signal to a second feed point and not the first feed point of the antenna (block 808), and the illustrative method ends (block 812). Much like transmitting the electromagnetic wave with the first polarization, applying a time-varying electrical signal to the second feed point may comprise coupling the time-varying electrical signal to the second feed point by way of a switch. Likewise, the reason for transmitting an electrical magnetic wave with a second polarization may be, for example, to read a RFID tag coupled to an object. In other embodiments, the RFID tag may transmit the electromagnetic wave with the second polarization, such as an additional response to the interrogating signal from an RFID reader or in response to another interrogating single from the RFID reader.

Consider, for example, a manufacturing facility where articles are transported from place to place on a conveyor, and where the physical orientation of each object is important. The object could be tagged with a RFID tag that, when interrogated, responds with an electromagnetic signal whose polarization is aligned with a particular orientation of the object. For example, if the object is upright, the polarization of the electromagnetic signal of the RFID tag could be vertically polarized, and if the object is on its side, the polarization could be horizontal. A system, such as system 2000 of FIG. 2, could thus determine the physical orientation of the object by the polarization of the electromagnetic signal produced by the RFID tag. Rather than have two reading antennas (one vertically polarized and one horizontally polarized), a single reading antenna (such as patch antenna 300 of FIG. 3) could be used to determine the polarization of the signal from the RFID tag, and thus determine the physical orientation of the object.

With regard to each of the transmitting steps discussed above, in some embodiments transmitting is by way a patch antenna having a plurality of feed points, where each feed point is disposed either within an area defined by the length and width of an antenna element of the patch antenna, or along the perimeter. The feed points, alone or in combination, produce electromagnetic waves having a plurality of polarizations such as: vertical polarization; horizontal polarization; right-circular polarization; or left-circular polarization.

Figure 9:
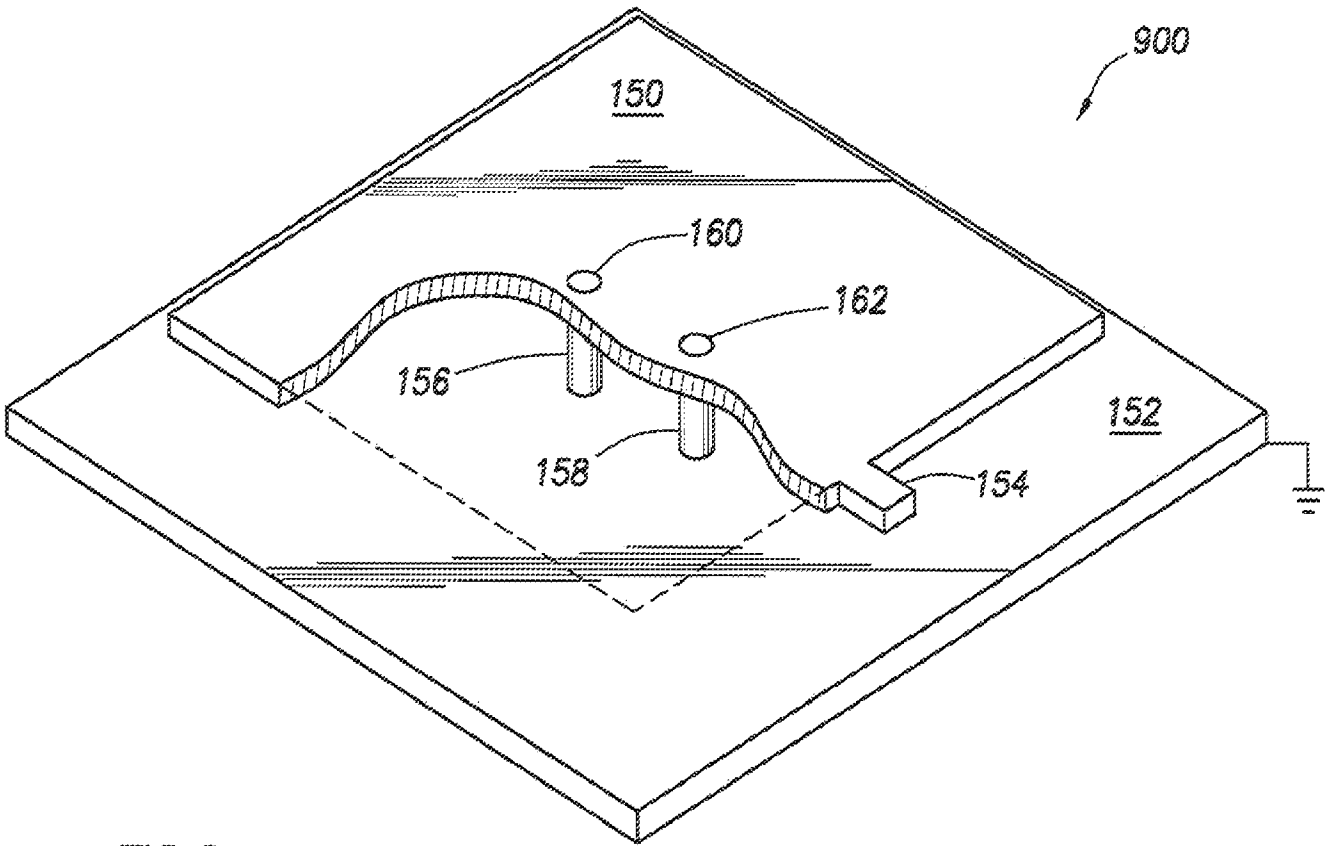
FIG. 9 shows a patch antenna with ground points in accordance with at least some embodiments.

The various embodiments discussed to this point have been in relation to antennas where various feed points are selectively used to create varying polarization. Other embodiments create varying polarizations by the selective use of ground points on the antenna element (with a single feed point, or with multiple feed points as discussed above). In particular, FIG. 9 illustrates a partial cut-away view of a patch antenna 900 in accordance with at least some embodiments. In particular, patch antenna 900 comprises a radiative patch or antenna element 150. In the embodiments shown, the antenna element 150 comprises a sheet of metallic material (e.g., copper) in the form of a square or rectangle that defines a perimeter. The patch antenna 900 also comprises a ground plane or ground element 152. The antenna element 150 and the ground element 152 each define a plane, and those planes are substantially parallel in at least some embodiments. Although the antenna element 150 and ground element 152 may be separated by air as shown, in other embodiments a dielectric material (e.g., printed circuit board material, silicon, plastic) separates the antenna element 150 from the ground element 152. Radio frequency signals are driven to the antenna element 150 by way of a feed point 154, illustrated in FIG. 9 as an edge feed; however, in other embodiments multiple feed points along the edge or within the perimeter defined by the antenna element 150 may be used.

FIG. 9 also illustrates a plurality of ground posts 156 and 158 extending between and electrically coupling the ground element 152 to the antenna element 150 at the ground points 160 and 162 respectively. Although only two ground points 160, 162 and two ground posts 156, 158 are shown, any number of ground points may be equivalently used. In these embodiments polarization of the patch antenna 900 is controlled, at least in part, by the number, placement and selective use of ground points. Thus, the polarization may be controlled not only by varying the feed points used, but also by varying quantity and/or location of ground points on the antenna element 150.

Figure 10:
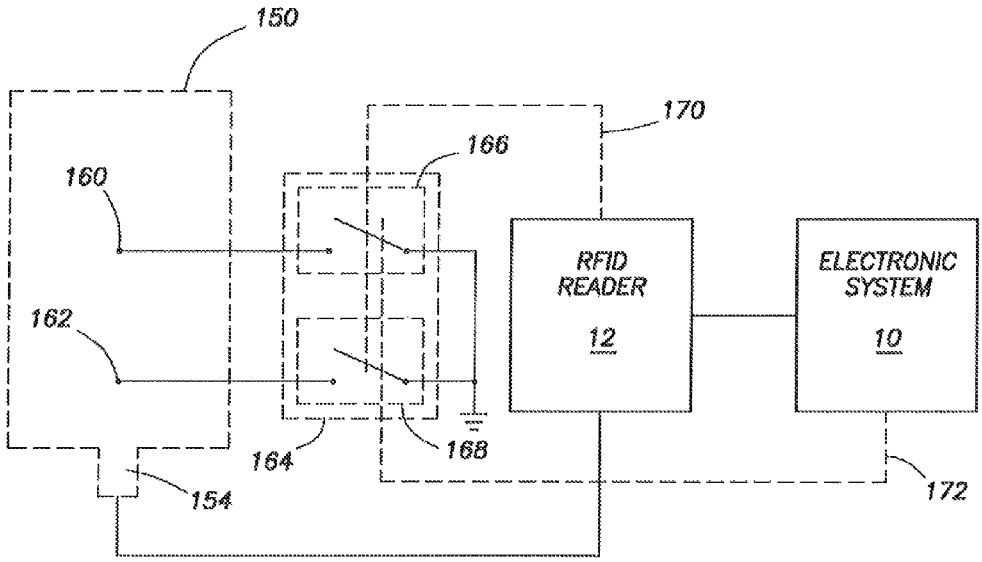
FIG. 10 shows an electrical block diagram of a system in accordance with at least some embodiments.

FIG. 10 shows an electrical block diagram that illustrates coupling of the RFID reader 12 to the antenna element 150 in accordance with at least some embodiments. In particular, antenna element 150 comprises an illustrative two ground points 160 and 162, along with illustrative edge feed point 154, as discussed with respect to FIG. 9. Each ground point 160, 162 selectively couples to ground through a switch assembly 164, which is illustrated as individual single-pole single-throw switches 166 and 168. However, in embodiments where the switch assembly 164 couples the ground points to ground in a mutually exclusive manner, the switch assembly 164 could be a single-pole double-throw switch. In some embodiments, the switch assembly 164 and/or the individual switches 166, 168 physically reside between the antenna element 150 and the ground element 154 (FIG. 9) to shorten the lead lengths between the ground points and the ground connection, but the switch assembly and/or switches may equivalently reside at any convenient location.

Consider first situations where the RFID reader 12 and/or electronic system 10 are configured to transmit electromagnetic signals having an illustrative first polarization. In order to ground the ground point 160, switch 166 is closed or made conducting, while switch 168 is opened or made non-conducting. The RFID reader 12 generates an antenna feed signal, and the antenna feed signal is applied to the illustrative edge feed point 154. In turn, the antenna element 150 radiates an electromagnetic wave having the first polarization. Now consider a similar situation, except where the RFID reader 12 and/or electronic system 10 are configured to receive electromagnetic signals with the first polarization. In order to ground the ground point 160, switch 166 is again closed or made conducting, while switch 168 is again opened or made non-conducting. The antenna element 150 produces an electrical signal that moves between the illustrative edge feed point 154 and the RFID reader 12, the electrical signal predominantly proportional to electromagnetic radiation incident upon the antenna element 150 having the first polarization.

Next consider situations where the RFID reader 12 and/or electronic system 10 are configured to transmit electromagnetic signals having an illustrative second polarization, different than the first polarization. In order to ground the ground point 162, switch 168 is closed or made conducting, while switch 166 is opened or made non-conducting. The RFID reader 12 generates an antenna feed signal, and the antenna feed signal is applied to the illustrative edge feed point 154. In turn, the antenna element radiates an electromagnetic wave having the illustrative second polarization. Now consider a similar situation, except where the RFID reader 12 and/or electronic system 10 are configured to receive electromagnetic signals with the second polarization. In order to ground the ground point 162, switch 168 is again closed or made conducting, while switch 166 is again opened or made non-conducting. The antenna element 150 produces an electrical signal that moves between the illustrative edge feed point 154 and the RFID reader 12, the electrical signal predominantly proportional to the electromagnetic radiation incident upon the antenna element 120 having the second polarization.

The switch assembly 164 used to selectively to ground the ground points 160, 162 may take many forms. For example, in some embodiments one or more mechanical switches are used, where the mechanic switches are closed (made conducting) or opened (made non-conducting) by physical manipulation of the switches (e.g. knife blade switches). In other embodiments, the switch assembly 164 is one or more electrically controlled switches. Examples of electrically controlled switches that may be used are solenoid operated relays, or solid state switches (e.g. transistors, silicon controlled rectifier pairs). Moreover, there are different types of transistors that may be used, for example metal oxide semiconductor field effect transistors (MOSFETs) or junction transistors. The device that controls the electrically controlled switches 166 and 168 may vary as well. In some embodiments, the RFID reader 12 controls the switch positions of the illustrative switches, as shown by dashed line 170 in FIG. 10. In other embodiments, the electronic system 10 controls the switch positions of the illustrative switches, as shown by dashed lines 172 in FIG. 10.

Figure 11:
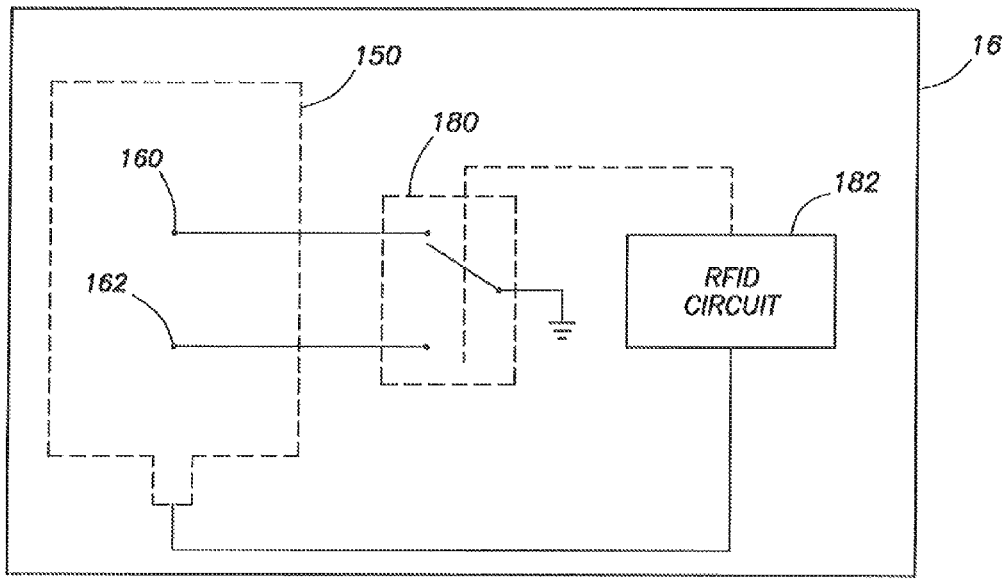
FIG. 11 shows a RFID tag in accordance with at least some embodiments.

The ability to radiate and receive electromagnetic waves of varying polarization based on selectively grounding the ground points is not limited to the antennas used with RFID readers 12, and indeed may also be implemented in RFID tags. FIG. 11 shows an RFID tag 16 in accordance with other embodiments. In particular, the RFID tag 16 comprises antenna element 150 having at least two ground points 160 and 162, each ground point associated with a different polarization antenna element 150. The ground points 160 and 162 couple to ground by way of a switch assembly 180, which as illustrated is a single-pole double-throw switch, controlled by the RFID circuit 182. In other embodiments, the switch assembly 180 may comprise individual switches (e.g. two single-pole single-throw switches). RFID tags are, in most but not all cases, relatively small (e.g. credit card sized) objects, and thus while mechanical switches and solenoid controlled relays may be used as the switch assembly 180, for size considerations the switch assembly 180 in most situations is solid state.

The RFID circuit 182 may be configured in many ways. In some embodiments the RFID circuit 182 controls the switch assembly 180 and transmits electromagnetic signals with particular polarization responsive to specific commands from an RFID reader. In other embodiments, the RFID circuit is preprogrammed to transmit electromagnetic signals of varying polarization, such as in a progression after each interrogation, or alternating polarizations based on successive interrogations.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

The invention claimed is:

1. A system comprising:

a first antenna having a first feed point;

a second antenna having a second feed point;

an antenna communication circuit configured to selectively tune and de-tune at least one of the first antenna and the second antenna; and a switch assembly that selectively couples the antenna communication circuit to the first feed point of the first antenna, and that selectively couples the antenna communication circuit to the second feed point of the second antenna, wherein the first antenna transmits an electromagnetic wave having a first polarization when the first antenna is selectively tuned and de-tuned with respect to the first feed point, and wherein the second antenna transmits an electromagnetic wave having a second polarization when the second antenna is selectively tuned and de-tuned with respect to the second feed point.

2. The system according to claim 1 wherein the switch assembly further comprises a mechanical switch whose switch positions are changed by physical manipulation.

3. The system according to claim 1 wherein the switch assembly further comprises an electrically controlled switch.

4. The system according to claim 1 wherein the switch assembly is one or more selected from the group consisting of: solenoid operated relay, field effect transistor, junction transistor, and silicon controlled rectifier pair.

5. The system according to claim 1 wherein the switch assembly comprises a first switch and a second switch; and wherein the antenna communication circuit controls a switch position of each of the first and second switches.

6. The system according to claim 1 wherein the first antenna and the second antenna each further comprises:

an antenna element that defines a perimeter;

a ground plane; and a radiative element suspended over the ground plane, wherein the corresponding feed point is one or more selected from the group consisting of: within the perimeter and disposed on the perimeter.

7. The system according to claim 6 wherein the first antenna and the second antenna each further comprises a dielectric material disposed between the radiative element and the ground plane.

8. The system according to claim 1 wherein the antenna communication circuit is one or more selected from the group consisting of: a radio frequency identification (RFID) reader and a RFID circuit within an RFID tag.

9. A system comprising:

a first reading antenna having a first feed point associated with a first polarization of the first reading antenna;

a second reading antenna having a second feed point associated with a second polarization of the second reading antenna;

a radio frequency identification (RFID) reader circuit configured to generate an interrogation signal; and a switch assembly that selectively couples the RFID reader circuit to the first feed point of the first reading antenna, and that selectively couples the RFID reader circuit to the second feed point of the second reading antenna, wherein when the interrogation signal is applied to the first reading antenna through the first feed point, the first reading antenna produces electromagnetic radiation with the first polarization, and wherein when the interrogation signal is applied to the second reading antenna through the second feed point, the second reading antenna produces electromagnetic radiation with the second polarization.

10. The system according to claim 9 wherein when the interrogation signal is applied to the first feed point, the interrogation signal is not applied to the second feed point.

11. The system according to claim 10 wherein when the interrogation signal is applied to the second feed point, the interrogation signal is not applied the first feed point.

12. The system according to claim 9 wherein the switch assembly comprises a first switch and a second switch, and wherein the RFID reader circuit controls the switch position of each of the first and second switches.

13. A radio frequency identification (RFID) tag comprising:

a first tag antenna;

a second tag antenna;

a RFID circuit configured to generate a responsive signal, wherein the responsive signal is responsive to an interrogation of the RFID tag; and a switch assembly that selectively couples the RFID circuit to a first feed point of the first tag antenna, and that selectively couples the RFID circuit to a second feed point of the second tag antenna, wherein the first feed point is associated with a first polarization of the first tag antenna, and the second feed point is associated with a second polarization of the second tag antenna, wherein when the responsive signal is applied to the first tag antenna by way of the first feed point, the first tag antenna produces electromagnetic radiation with the first polarization, and wherein when the responsive signal is applied to the second tag antenna through the second feed point, the second tag antenna produces electromagnetic radiation with the second polarization.

14. The RFID tag according to claim 13 wherein when the responsive signal is applied to the first feed point, the responsive signal is not applied to the second feed point.

15. The RFID tag according to claim 14 wherein when the responsive signal is applied to the second feed point, the responsive signal is not applied the first feed point.

16. The RFID tag according to claim 13 wherein the switch assembly comprises a first switch and a second switch, and wherein the RFID reader circuit controls the switch position of each of the first and second switches.

17. A system comprising:

a first antenna having a first feed point;

a second antenna having a second feed point;

a first antenna communication circuit configured to produce an electrical signal proportional to electromagnetic radiation incident upon the first antenna;

a second antenna communication circuit configured to produce an electrical signal proportional to electromagnetic radiation incident upon the second antenna; and a switch assembly that selectively couples the first antenna communication circuit to the first feed point, and that selectively couples the second antenna communication circuit to the second feed point, wherein when the electrical signal is conducted between the first feed point and the first antenna communication circuit, the electrical signal is predominantly proportional to electro-magnetic radiation incident on the first antenna having a first polarization, and wherein when the electrical signal is conducted between the second feed point and the second antenna communication circuit, the electrical signal is predominantly proportional to electro-magnetic radiation incident on the second antenna having a second polarization.

18. The system according to claim 17 wherein first polarization is one or more selected from the group consisting of: vertical polarization, horizontal polarization, right-circular polarization, or left circular polarization.

19. A system comprising:

a first reading antenna having a first feed point associated with a first polarization of the first reading antenna;

a second reading antenna having a second feed point associated with a second polarization of the second reading antenna;

a radio frequency identification (RFID) reader circuit configured to receive at least one of a first electrical signal from the first reading antenna and a second electrical signal from the second reading antenna, wherein the first electrical signal is proportional to electromagnetic radiation incident upon the first reading antenna and the second electrical signal is proportional to electromagnetic radiation incident upon the second reading antenna; and a switch assembly that selectively couples the RFID reader circuit to the first feed point of the first reading antenna, and that selectively couples the RFID reader circuit to the second feed point of the second reading antenna, wherein when the first electrical signal is received through the first feed point of the first reading antenna, the first electrical signal is predominantly proportional to electromagnetic radiation incident on the first reading antenna having the first polarization, and wherein when the second electrical signal is received through the second feed point, the second electrical signal is predominantly proportional to electromagnetic radiation incident on the second reading antenna having the second polarization.

20. A radio frequency identification (RFID) tag comprising:

a first tag antenna;

a second tag antenna;

a RFID circuit configured to selectively tune and de-tune the first tag antenna and the second tag antenna; and a switch assembly that selectively couples the RFID circuit to a first feed point of the first tag antenna, and that selectively couples the RFID circuit to a second feed point of the second tag antenna, wherein the first feed point is associated with a first polarization of the first tag antenna, and the second feed point is associated with a second polarization of the second tag antenna, wherein the first tag antenna transmits an electromagnetic wave having the first polarization when the first tag antenna is selectively tuned and de-tuned with respect to the first feed point, and wherein the second tag antenna transmits an electromagnetic wave having the second polarization when the second tag antenna is selectively tuned and de-tuned with respect to the second feed point.

21. A radio frequency identification (RFID) tag comprising:

a first tag antenna;

a second tag antenna;

a RFID circuit configured to receive a first interrogating signal from the first tag antenna and a second interrogating signal from the second tag antenna, wherein the first interrogating signal is proportional to electromagnetic radiation incident upon the first tag antenna, and wherein the second interrogating signal is proportional to electromagnetic radiation incident upon the second tag antenna; and a switch assembly that selectively couples the RFID circuit to a first feed point of the first tag antenna, and that selectively couples the RFID circuit to a second feed point of the second tag antenna, wherein the first feed point is associated with a first polarization of the first tag antenna, and the second feed point is associated with a second polarization of the second tag antenna, wherein when the first interrogating signal is received by way of the first feed point, the first interrogating signal is predominantly proportional to the electromagnetic radiation incident on the first tag antenna having the first polarization, and wherein when the second interrogating signal is received by way of the second feed point, the second interrogating signal is predominantly proportional to the electromagnetic radiation incident on the second tag antenna having the second polarization.

* * * * *

UNITED STATES PATENT AND TRADEMARK OFFICE

CERTIFICATE OF CORRECTION

PATENT NO. : 7,932,867 B2
APPLICATION NO. : 12/906516
DATED : April 26, 2011
INVENTOR(S) : John R. Tuttle It is certified that error appears in the above-identified patent and that said Letters Patent is hereby corrected as shown below:

Column 2, line 1 “a RFID” should read --an RFID--.
Column 2, line 9, “a RFID” should read --an RFID--.
Column 2, line 23, after “to . . . .” insert --”--.
Column 2, line 32, “a RFID” should read --an RFID--.
Column 2, line 49, “a RFID” should read --an RFID--.
Column 2, line 54, “referred as” should read --referred to as--.
Column 3, line 20, “reader 12 antenna” should read --reader 12 and antenna--.
Column 4, line 6, “determine” should read --determines--.
Column 4, line 34, “identifies the which” should read --identifies which--.
Column 4, line 60, “element 40 is” should read --element 40 are--.
Column 6, line 2, “two antennas and” should read --two antennas 70 and--.
Column 6, line 19, “are” should read --is--.
Column 6, line 33, “are configured” should read --is configured--.
Column 6, line 42, “system 10 are” should read --system 10 is--.
Column 6, line 55, “system 10 are” should read --system 10 is--.
Column 6, line 64, “selectively to couple” should read --selectively couple--.
Column 6, line 67, “mechanic switches” should read --mechanical switches--.
Column 8, line 10, “on made” should read --or made--.
Column 8, line 58, “Switch may take” should read --A switch may take--.
Column 8, line 59, “by way of switch” should read --by way of the switch--.
Column 8, line 64, “a RFID” should read --an RFID--.
Column 9, line 19, “a RFID” should read --an RFID--.
Column 9, line 28, “a RFID” should read --an RFID--.
Column 9, line 43, “by way a” should read --by way of a--.
Column 11, line 2, “system 10 are” should read --system 10 is--.
Column 11, line 11, “selectively to ground” should read --selectively ground--.
Column 12, line 35, “further comprises:” should read --further comprise:--.
Column 12, line 43, “further comprises” should read --further comprise--.
Column 12, line 49, “a RFID” should read --an RFID--.

Signed and Sealed this
Tenth Day of July, 2012

David J. Kappos

David J. Kappos
*Director of the United States Patent and Trademark Office*

Column 13, line 8, “not applied the” should read --not applied to the--.
Column 13, line 17, “a RFID” should read --an RFID--.
Column 13, line 42, “not applied the” should read --not applied to the--.
Column 14, line 41, “a RFID” should read --an RFID--.
Column 14, line 63, “a RFID” should read --an RFID--.